US005502286A

United States Patent [19]

Pollman et al.

[11] Patent Number: 5,502,286

[45] Date of Patent: Mar. 26, 1996

[54] BELL ALARM AND LOCK-OUT FOR HIGH AMPERE-RATED CIRCUIT BREAKERS

[75] Inventors: John A. Pollman, Seymour; Raymond K. Seymour, Plainville; Paul H. Singer, West Hartford; Paul T. Rajotte, Plainville, all of Conn.

[73] Assignee: General Electric Company, New York, N.Y.

[21] Appl. No.: 248,910

[22] Filed: May 25, 1994

[51] Int. Cl.[6] ..... H01H 23/00

[52] U.S. Cl. ..... 200/401; 200/308

[58] Field of Search ..... 200/400, 401, 200/308; 361/94, 49, 115; 335/17

[56] References Cited

U.S. PATENT DOCUMENTS

| | | | |
|---|---|---|---|
| 3,214,537 | 10/1965 | Krieger | 335/17 |
| 3,217,125 | 11/1965 | Brackett | 335/17 |
| 3,693,122 | 9/1972 | Willard . | |
| 3,760,307 | 9/1973 | Patel | 335/17 |
| 4,672,501 | 6/1987 | Bilac et al. . | |
| 4,870,531 | 9/1989 | Danek . | |
| 4,939,490 | 7/1990 | Bernier et al. . | |
| 5,258,732 | 11/1993 | Marquardt | 335/17 |

FOREIGN PATENT DOCUMENTS

| | | |
|---|---|---|
| 506249 | 3/1994 | United Kingdom . |
| 506257 | 3/1994 | United Kingdom . |

OTHER PUBLICATIONS

Castonguay et al U.S. Patent Application SN: 08/202,140 filed Feb. 25, 1994 entitled "Operating Mechanism for High Ampere–Rated Circuit Breakers". (Docket: 41PR–7116).

Santos et al U.S. Patent Application SN: filed entitled "Digital Circuit Interrupter with Multiple Accessory Function" (Docket: 41PR–7170).

*Primary Examiner*—David J. Walczak

*Attorney, Agent, or Firm*—Richard A. Menelly

[57] ABSTRACT

A combined bell alarm and lock-out accessory is connected with the electronic trip unit that controls a high ampere rated circuit breaker. The accessory interacts with the circuit breaker operating mechanism to activate the bell alarm upon circuit interruption and to prevent the closing of the circuit breaker contacts until the accessory is manually reset.

17 Claims, 3 Drawing Sheets

BELL ALARM AND LOCK-OUT FOR HIGH AMPERE-RATED CIRCUIT BREAKERS

BACKGROUND OF THE INVENTION

U.S. Pat. No. 4,939,490 entitled "Molded Case Circuit Breaker Bell Alarm Unit" describes a circuit breaker bell alarm unit that interacts with the circuit breaker operating mechanism to provide remote indication of the ON and OFF conditions of the circuit breaker contacts. The unit is self-contained within an enclosure that is inserted within an accessory recess in the circuit breaker cover. The recess accepts one accessory only so that the operator must decide which of a multiple variety of accessories best suits his requirements.

U.S. patent application Ser. No. 08/248,900 entitled "Modular Accessories for Circuit Breakers" discloses an enclosure that is capable of supporting several different accessory units each of which can be made operational by the operator.

U.S. patent application Ser. No. 08/239,822 entitled "Digital Circuit Interrupter with Multiple Accessory Function" describes a simple selector switch arrangement that electronically provides selection of any one of several accessory functions along with automatic circuit breaker overcurrent protection.

U.S. Pat. No. 4,672,501 entitled "Circuit Breaker and Protective Relay Unit" describes the use of a digital circuit interrupter employing a microprocessor in combination with ROM and RAM memory elements to provide both relaying as well as protection function to an electrical distribution system.

The purpose of the instant invention is to describe a combined bell alarm and lock-out accessory that can be installed within the circuit breaker cover as one of the aforementioned plurality of selectable circuit breaker accessory functions.

SUMMARY OF THE INVENTION

A combined bell alarm and lock-out accessory plugs onto the associated electronic trip unit that controls a high ampere rated circuit breaker. The accessory includes a flux shifter unit that provides both local and remote indication of the condition of the circuit breaker contacts when tripped as well as preventing the contacts from being closed until the accessory unit is manually reset.

DESCRIPTION OF THE PREFERRED EMBODIMENT

Figure 1:
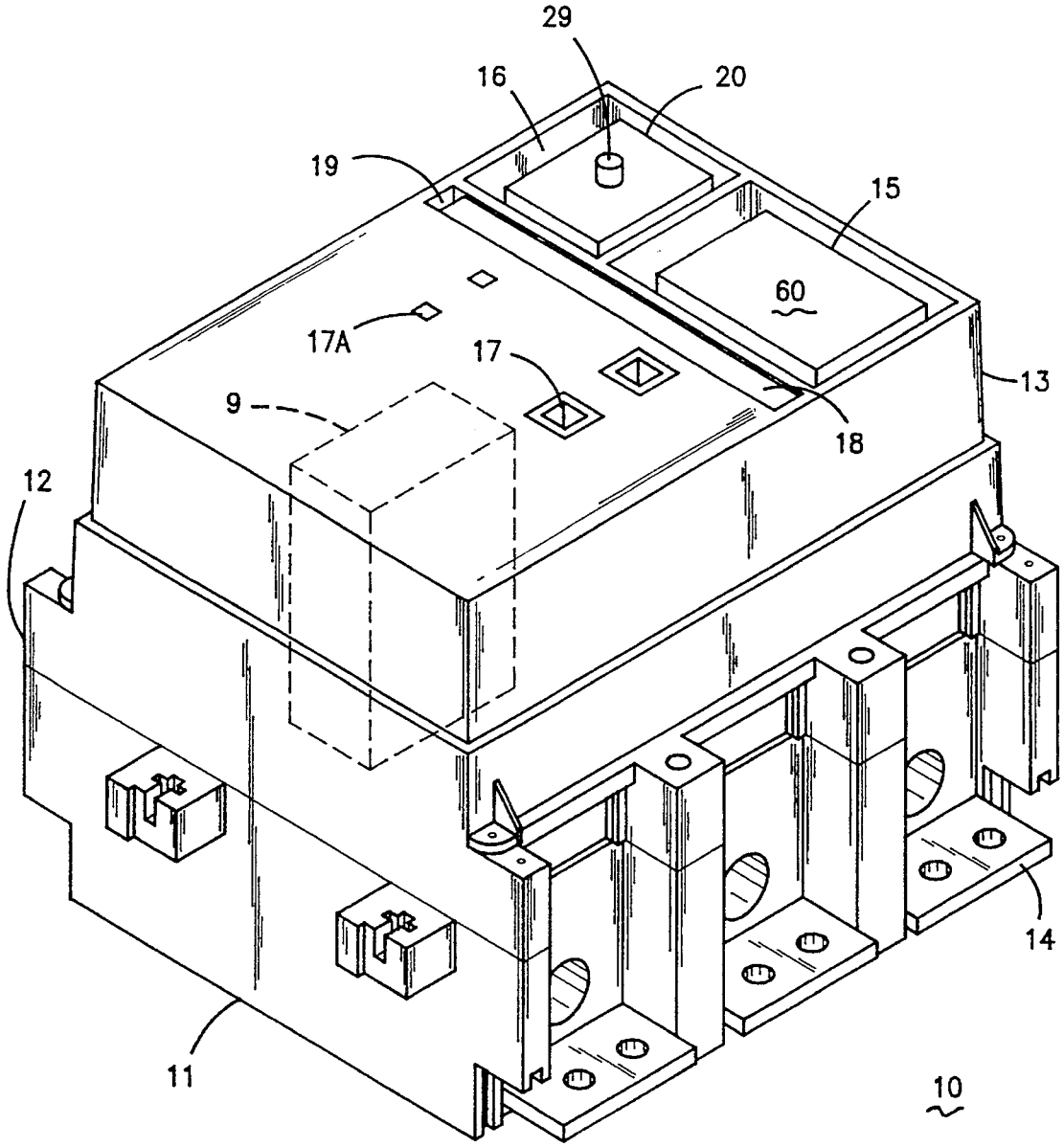
FIG. 1 is a top perspective view of a high ampere rated circuit breaker employing the combined bell alarm and lock-out accessory according to the invention.

The high ampere-rated circuit breaker 10 shown in FIG. 1 is described in U.S. patent application (41PR-7116) entitled "Operating Mechanism for High Ampere-rated Circuit Breakers" and is capable of transferring several thousand amperes quiescent circuit current at several hundred volts potential without overheating. The circuit breaker consists of an electrically insulated base 11 to which an intermediate cover 12 of similar insulative material is attached prior to attaching the top cover 13, also consisting of an electrically-insulative material. The operating mechanism 9 as described within the aforementioned U.S. patent application (41PR-7116) controls the condition of the circuit breaker contacts. Electrical connection with the interior current-carrying components is made by load terminal straps 14 extending from one side of the base and line terminal straps (not shown) extending from the opposite side thereof. The interior components are controlled by an electronic trip unit 60 contained within a recess 15 on the top surface of the top cover 13. The trip unit 60 is similar to that described within the aforementioned U.S. Pat. No. 4,672,501 and interacts further with the combined bell alarm and lock-out accessory 20 contained within the accessory recess 16. The reset button 29 extending from the top of the bell alarm and lock-out accessory serves to provide reset function to the accessory as well as indication as to whether the circuit breaker operating mechanism is operative. ON and OFF buttons 17 and ON and OFF indicators 17A accessible from the top cover allow manual operation of the circuit breaker operating mechanism to separate the circuit breaker contacts. An operating handle 18 within the handle recess 19 allows the circuit breaker operating mechanism to be manually reset after automatic separation of the circuit breaker contacts. The reset button 29 on the top surface of the bell alarm and lock-out accessory 20 allows the accessory to be reset if the accessory is not in a lock-out mode as will be described below.

Figure 2B:
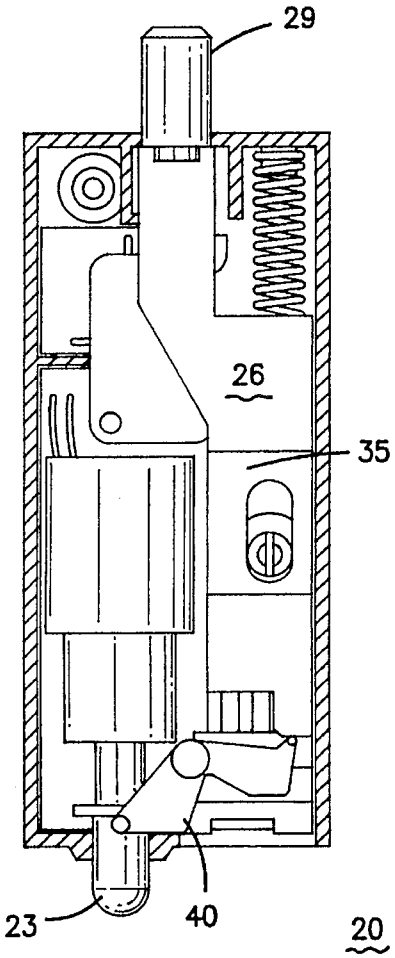
FIGS. 2A and 2B are side views of the circuit breaker of FIG. 1 depicting the accessory in reset and actuated conditions.
Figure 2A:
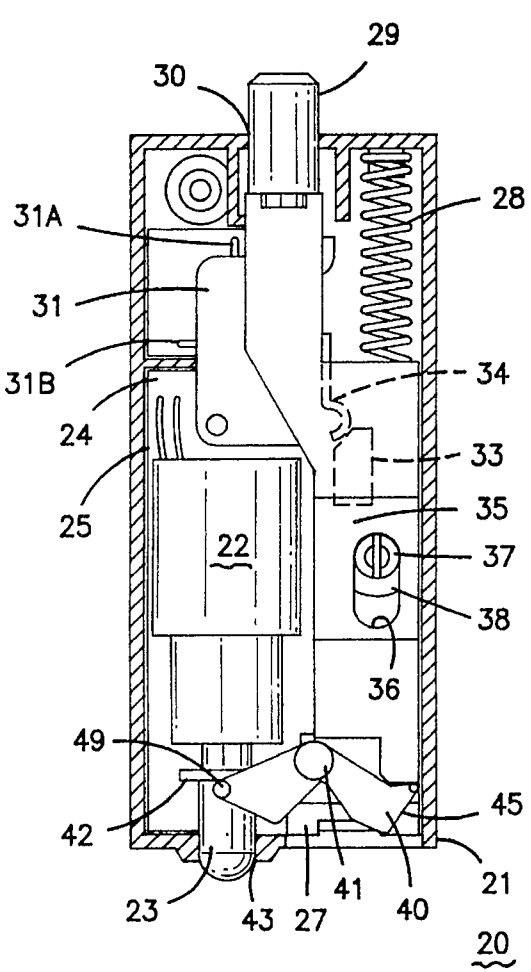

The operation of the bell alarm and lock-out accessory 20 is best seen by now referring to FIGS. 2A and 2B which depict the accessory in the latched and unlatched conditions respectively. As described within British Patent Application (41PR-7139) entitled "Modular Bell Alarm and Lockout Assembly", the bell alarm and lock-out accessory 20 is contained within an insulative housing 21 and includes a flux shifter unit 22 of the type disclosed in U.S. Pat. No. 3,693,122 wherein a plunger 23 is restrained against a spring bias by means of a permanent magnetic flux. Upon receipt of a voltage signal of magnetic flux of opposite polarity, the "holding" flux is defeated such that the plunger becomes extended by the spring bias force. The flux shifter is captured in one side of the insulated housing not shown and arranged next to a printed circuit board 24 that is electrically connected with the circuit breaker trip unit by means of the plug-in contacts 27 arranged at the bottom and the conductors 25 leading from the flux shifter. The associated microswitch 31 connects with the printed circuit board by means of conductors 31A, 31B as indicated. The accessory 20 is depicted in its "latched" condition in FIG. 2A, with the plunger 23 withdrawn from the opening 43 and out of interference with the circuit breaker operating mechanism. A reset button 29 is arranged at the end of the accessory opposite from the plunger and extends partly through the opening 30 arranged at the top of the accessory. Mechanical logic is provided between the plunger and the reset button whereby the reset button also provides visual indication of the state of the plunger by becoming extended fully outside the accessory when the plunger is released, as depicted in FIG. 2B. The plate 35 is slidably arranged between a screw 37 and a spool 38 positioned on opposite sides of the elongated slot 36 whereby motion is transmitted from the plunger to the plate by means of the lever 40 that is attached to the plate by means of the pivot pin 41 molded into the top of the insulative housing. One side of the lever is forced against a collar 42 on the plunger by an "L-shaped" portion of lever 40 as depicted at 49 and the other side of the lever is attached to the plate by a second "L-shaped" portion of lever 40 as depicted at 45. The plate is biased to its latched position in FIG. 2A by means of the extension spring 28. Upon excitation of the flux shifter 22 by application of a signal over conductors 25, the flux shifter releases the plunger 23 which then allows the plunger to drive the plate 35 against the bias force of the extension spring 28 to return to its extended position as shown in FIG. 2B and the reset button 29 to return to its extended position. In the process of moving the plate 35, the protrusion 33 formed on the plate strikes the switch lever 34 to activate a remote indicator lamp or siren over conductors 31A, 31B that the circuit breaker contacts have become separated. The lock-out feature of the invention is accomplished by the interference provided between the circuit breaker operating mechanism and the extended plunger 23 as depicted in FIG. 2B to prevent the circuit breaker operating mechanism from being reset to close the circuit breaker contacts until the reset button 29 is depressed to mechanically translate the slide 26 in the downward indicated direction to rotate the back to the position shown in FIG. 2A and drive the plunger back within the flux shifter 22. The absence of a voltage signal on the conductors 25 allows the plunger to be magnetically retained in the latched position out of interference with the circuit breaker operating mechanism to thereby allow the circuit breaker contacts to be moved to their closed condition as described in the aforementioned U.S. patent application (41PR-7116) entitled "Operating Mechanism for High Ampere-rated Circuit Breakers".

Figure 4:
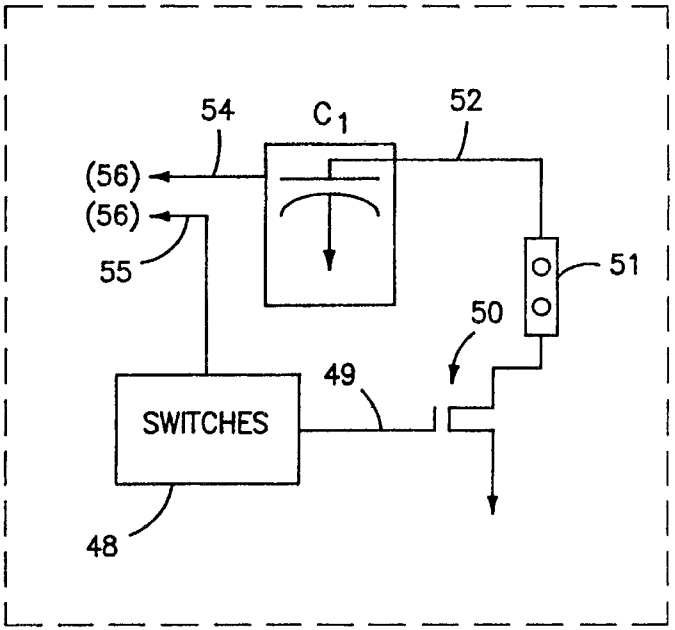
FIG. 4 is schematic representation of the components within the output control circuit within the trip unit of FIG. 3.
Figure 3:
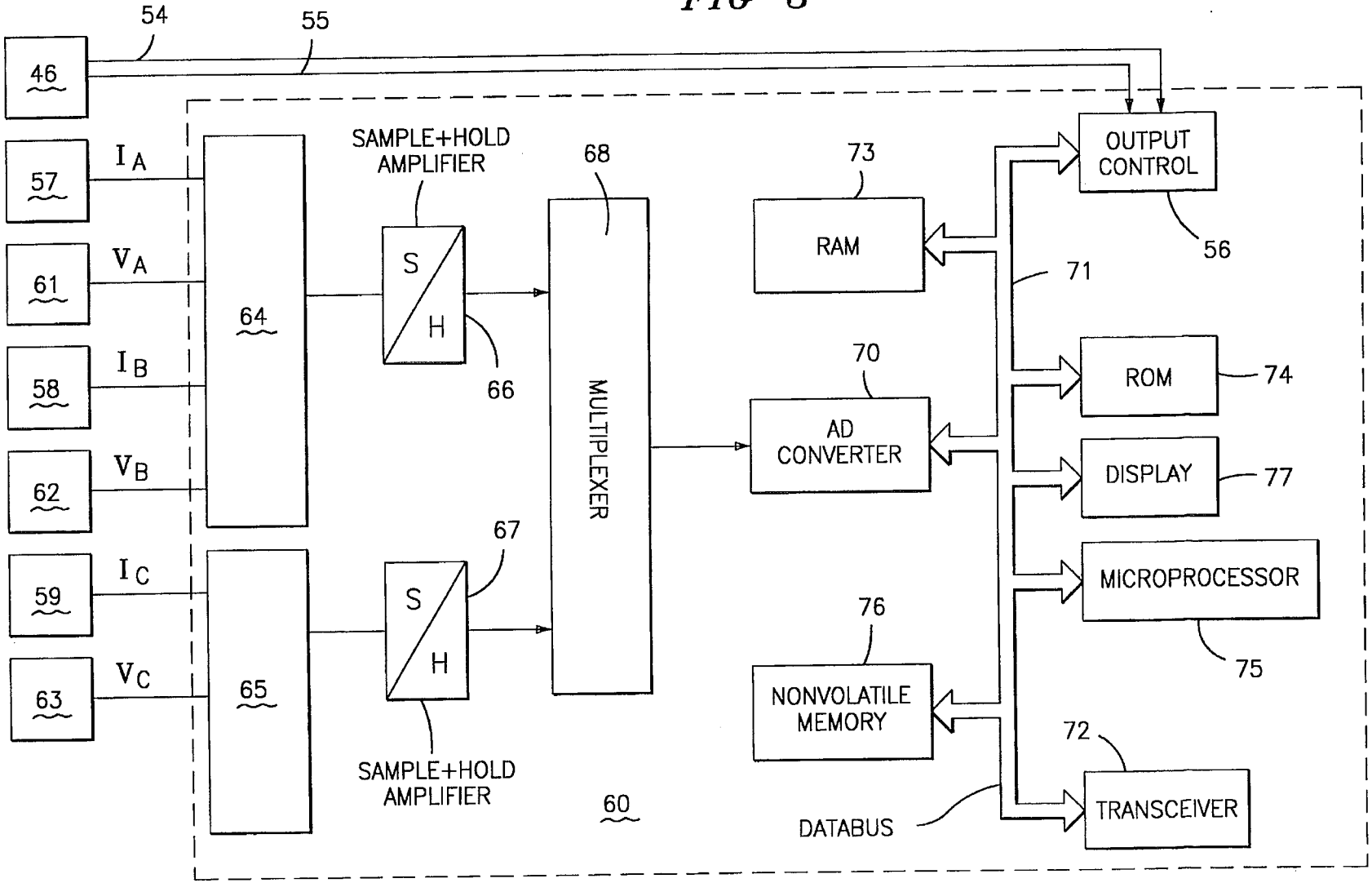
FIG. 3 is a schematic representation of the trip unit within the circuit breaker of FIG. 1.

The arrangement of the bell alarm and lock-out accessory 46 relative to the circuit breaker trip unit 60 is seen by referring now to FIG. 3. External connection with the trip unit is made with current transformers 57–59 and potential transformers 61–63 to supply operating power to the trip unit components as well as indication of the level of current through an associated electric circuit. The electrical input is transmitted through multiplexers 64, 65, 68 and sample and hold amplifiers 66, 67 to an A/D converter 70 and control is achieved by utilization of a data bus 71 which is interconnected with an output control 56, transceiver 72, and RAM 73. The ROM 74, microprocessor 75 and nonvolatile memory 76 operate in the manner described therein to insure complete overall circuit protection. The information as to the status of the circuit breaker contacts (not shown) that are controlled by the output control 56 is displayed on the display 77 that is similar to that described in U.S. Pat. No. 4,870,531 entitled "Circuit Breaker removable Display and Keyboard". In accordance with the invention, the bell alarm and lock-out circuit 46 connects with the output control 56 by means of the conductors 54, 55 by interconnection between the plug in connector 27 (FIG. 2A) and the receptacle 51 as shown within the bell alarm and lock-out circuit 46 depicted in FIG. 4. The circuit 46 interacts with a plurality of selection switches 48 in the manner described within the aforementioned U.S. patent application (41PR-7170) entitled "Digital Circuit Interrupter with Multiple Accessory Function" to allow the operator to select the bell alarm and lock-out accessory function by connecting between conductor 55 and conductor 49 to gate the FET 50 and provide connection between one side of the receptacle 51 and ground. The other side of the receptacle connects with a storage capacitor C1 over conductor 52 to provide operating power from the capacitor to output control 56 shown in FIG. 3. With the bell alarm and lock-out circuit 46 connected to the output control 56 via conductors 54, 55 insertion of the plug in connector 27 (FIG. 2A) readily provides electrical operational power to the flux shifter 22 to allow immediate bell alarm and lock-out facility to the circuit breaker. The microswitch 31 is isolated for operational connections and the connector 27 provides an interface with the customer wire harness (not shown).

We claim:

1. An industrial-rated circuit breaker for high level overcurrent protection comprising:

an insulative base and an insulative cover;

an operating mechanism in said base controlled by an electronic trip unit arranged within a trip unit recess in said cover; and a bell alarm and lock-out accessory unit arranged within an accessory recess 16 in said cover, said accessory unit including a reset button extending from a top of said accessory unit to provide indication as to the condition of said operating mechanism and to allow manual reset function to said accessory unit, said accessory unit further includes a flux shifter having a plunger extending from said accessory unit at a bottom thereof;

a plate connecting between said reset button and said plunger, said plate being slidably arranged within said accessory unit between a latched and an unlatched position;

a switch interacting with said plate to thereby turn said switch on and off by contact with said plate between said latched and unlatched positions; and a printed circuit board connecting with said switch and said flux shifter, said printed circuit board including means for removably connecting with said circuit breaker trip unit.

2. The industrial-rated circuit breaker of claim 1 including a spring biasing said plate between said latched and said unlatched positions.

3. The industrial-rated circuit breaker of claim 1 including a protrusion on said plate contacting a switch lever on said switch to turn said switch on and off.

4. The industrial-rated circuit breaker of claim 1 including a pivotal lever connecting between said plunger and said plate, whereby said plunger extends from said bottom in one direction and drives said plate and said reset button in an opposite direction thereby extending said reset button from said top.

5. The industrial-rated circuit breaker of claim 1 wherein said plate includes an elongated slot and said plate is slidably arranged by provision of a screw on one side of said slot received within a spool on an opposite side thereof.

6. The industrial-rated circuit breaker of claim 1 including bell alarm and lock-out accessory circuit means on said trip unit connecting with said flux shifter providing operating power to said flux shifter.

7. The industrial-rated circuit breaker of claim 1 wherein said printed circuit connecting means comprises a plug-in connector.

8. A combined bell alarm and circuit breaker lock-out accessory comprising in combination:

an enclosure;

a flux shifter having a plunger extending from a bottom of said enclosure: and a reset button extending from a top of said enclosure to provide indication as to the condition of an associated circuit breaker operating mechanism and to allow manual reset of said flux shifter;

a plate connecting between said reset button and said plunger, said plate being slidably arranged within said enclosure between a latched and an unlatched position;

a switch interacting with said plate to thereby turn said switch on and off by contact with said plate between said latched and unlatched positions; and a printed circuit board connecting with said switch and said flux shifter, said printed circuit board including means for removably connecting with an associated circuit breaker trip unit.

9. The combined bell alarm and circuit breaker lock-out accessory of claim 8 including a spring biasing said plate between said latched and said unlatched positions.

10. The combined bell alarm and circuit breaker lock-out accessory of claim 8 including means on said plate contacting a switch lever on said switch to turn said switch on and off.

11. The combined bell alarm and circuit breaker lock-out accessory of claim 10 wherein said means comprises a protrusion formed on said plate.

12. The combined bell alarm and circuit breaker lock-out accessory of claim 11 wherein said plate includes an elongated slot and said plate is slidably arranged by provision of a screw on one side of said slot received within a spool on an opposite side thereof.

13. The combined bell alarm and circuit breaker lock-out accessory of claim 10 including a pivotal lever connecting between said plunger and said plate, whereby said plunger extends from said bottom in one direction and drives said plate and said reset button in an opposite direction thereby extending said reset button from said top.

14. The combined bell alarm and circuit breaker lock-out accessory of claim 8 wherein said trip unit includes a bell alarm and circuit breaker lock-out circuit.

15. The combined bell alarm and circuit breaker lock-out accessory of claim 14 wherein said lock-out circuit includes a storage capacitor.

16. The combined bell alarm and circuit breaker lock-out accessory of claim 14 wherein said lock-out circuit further includes a transistor switch.

17. The combined bell alarm and circuit breaker lock-out accessory of claim 14 further including receptacle means on said lock-out circuit receiving said means for removably connecting with an associated circuit breaker trip unit.

* * * * *